United States Patent [19]

Fujimura et al.

[11] 4,256,401

[45] Mar. 17, 1981

[54] IMAGE DENSITY ADJUSTMENT METHOD AND APPARATUS

[75] Inventors: Itaru Fujimura, Tokyo; Hitoshi Nakamura, Kawasaki; Shoji Kuroishi, Yokohama; Nachio Seko, Sagamihara; Toshiyuki Ogawa, Kawasaki, all of Japan

[73] Assignee: Ricoh Company, Ltd., Japan

[21] Appl. No.: 1,407

[22] Filed: Jan. 8, 1979

[30] Foreign Application Priority Data

Jan. 18, 1978 [JP] Japan ..... 53/4084

[51] Int. Cl.[3] ..... G03G 15/00

[52] U.S. Cl. ..... 355/14 E; 355/10; 355/14 C; 355/14 D; 355/67; 355/77; 118/647; 430/31

[58] Field of Search ..... 355/14 C, 14 E, 14 D, 355/3 DD, 10, 67–71, 77; 96/1 R, 1 SD; 118/647–650; 430/31, 32

[56] References Cited

U.S. PATENT DOCUMENTS

| | | | |
|---|---|---|---|
| 4,035,069 | 7/1977 | Yano | 355/3 DD |
| 4,087,171 | 5/1975 | Yano | 355/10 X |

*Primary Examiner*—R. L. Moses

*Attorney, Agent, or Firm*—McGlew and Tuttle

[57] ABSTRACT

The image density adjustment method for use in electrophotography in which, when the image density of a copied image is decreased below a standard image density, the development bias-potenial is increased while the exposure to be applied to a photoconductor is kept constant. When the image density of a copied image is increased above the standard image density, the exposure is decreased while the development bias voltage is kept constant. Thus, the image density of a copied image can be adjusted as desired to minimize the effect of light fatigue of the photoconductor.

8 Claims, 13 Drawing Figures

IMAGE DENSITY ADJUSTMENT METHOD AND APPARATUS

BACKGROUND OF THE INVENTION

The present invention relates to an image density adjustment method to be employed in electrophotographic copying apparatus.

Conventionally, the following image density adjustment methods are known for use in electrophotographic copying apparatus: (1) the density of copied images is adjusted by changing the development bias potential while, at the exposure to be applied to a photoconductor is kept constant; (2) the image density of copied images is adjusted by changing the exposure while the development bias voltage is kept constant; (3) when the images density of copied image is decreased, the exposure is increased while, at the same time, the development bias potential kept constant and, when the image density is increased, the development bias potential is decreased while, at the same time the exposure is kept constant.

However, when the density of the background of a copied image is increased in order to reproduce a poor original clearly, fatigue of the photoconductor appears on the copied image in the above-mentioned methods (1) and (3) since the development bias potential is lowered while the exposure kept constant. In FIG. 1, an initial light decay curve of the background potential on a photoconductor is indicated by a solid line, and the light decay curve when the photoconductor is subject to fatigue is indicated by a broken line. Assuming that development is performed at the time $T_0$, the difference between the initial background potential and the background potential at the time of fatigue cannot be developed at a standard development potential $V_0$. Accordingly, the background does not appear on the copied image. However, when the development bias potential is reduced to $V_1$ in order to increase the density of the background of copied image, the difference between the initial background potential and the background potential at the time of fatigue is developed and the difference appears in the form of a ghost image on the copied image. Furthermore, when the image density is lowered in order to eliminate the background as in the above-mentioned methods (2) and (3), the fact that the exposure is increased while the development bias potential is kept constant causes fatigue of the photoconductor to be intensified so that the fatigue is reflected in the quality of the copied image.

FIG. 2 shows a light decay curve that results when a standard exposure is applied to the photoconductor and FIG. 3 shows the light decay curve that results when the exposure to be applied to the photoconductor is increased in order to decrease the image density of copied image. When the exposure is increased in order to decrease the image density of copied image, the difference between the light decay curve of the initial background potential and that of the background potential at the time of fatigue of the photoconductor becomes so great that the difference appears on the copied images even if the development bias potential is not changed.

SUMMARY OF THE INVENTION

It is therefore a primary object of the present invention to provide an image density adjustment method and apparatus capable of eliminating the shortcomings of the conventional image density adjustment methods and apparatus and capable of obtaining copied images having a desired image density by obviating fatigue of the photoconductor as much as possible.

According to the present invention, when the image density of copied image is decreased below a standard image density, the development bias potential is increased while the exposure is kept constant and, when the image density of copied image is increased above the standard image density, the exposure is decreased while the development bias potential is kept constant, whereby the image density of copied image can be adjusted as desired and yet light fatigue of the photoconductor will be minimized. At the same time, the copied image can be prevented from being affected by light fatigue of the photoconductor.

DETAILED DESCRIPTION OF THE PREFERRED EMBODIMENTS

Figure 1:
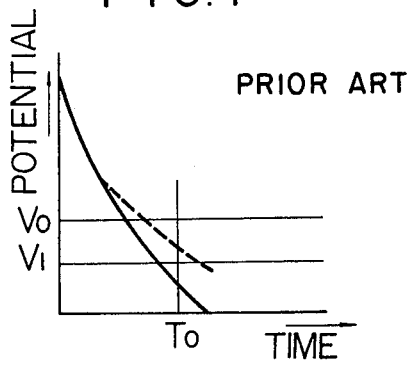
FIG. 1 shows the initial light decay curve of the background potential of a photoconductor and the light decay curve of the background potential of the photoconductor at the time of fatigue in the conventional image density adjustment method.
Figure 2:
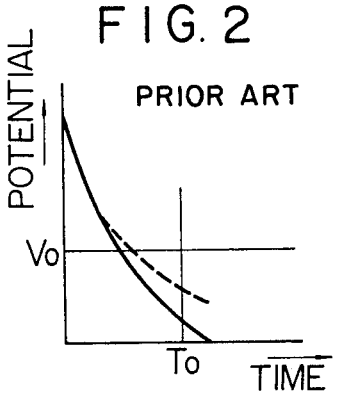
FIG. 2 shows the light decay curve typical of the application of a standard exposure to the photoconductor in the conventional image density adjustment method.
Figure 3:
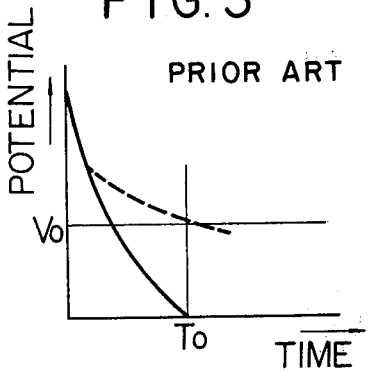
FIG. 3 shows the light decay curve that results when the exposure to be applied to the photoconductor is increased in the conventional image density adjustment method.
Figure 4:
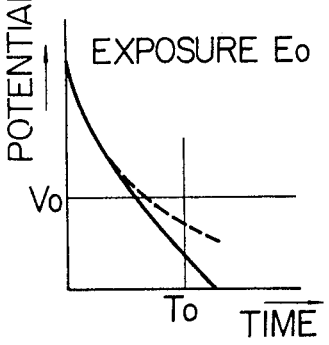
FIG. 4 shows the light decay curve that results when a standard exposure $E_0$ is applied to a photoconductor in accordance with the present invention.
Figure 5:
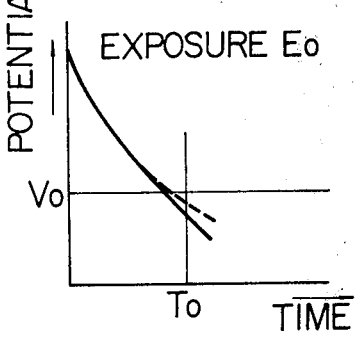
FIG. 5 shows the light decay curve that results when a decreased exposure $E_1$ is applied to the photoconductor in accordance with the present invention.

The density of an electrophotographic image is adjusted according to the present invention by lowering the exposure while the development bias potential is kept constant to increase the density of the background of copied image above the density of the background of a standard image in order to reproduce a poor image. FIG. 4 shows the light decay curve of a photoconductor when the standard exposure $E_0$ is applied to the photoconductor. FIG. 5 shows the light decay curve of the photoconductor as when a reduced exposure $E_1$ is applied to the photoconductor. As can be seen from FIGS. 4 and 5, when the exposure is reduced to $E_1$ in order to increase the density of the background of the copied image, the difference between the initial potential of the background and the potential of the background at the time of fatigue and when the exposure is $E_0$, almost as in FIG. 4, does not appear in the form of a ghost image on the copied image. When the image density of the copied image is reduced in order to eliminate the background of the copied image, the development bias potential is increased while the exposure is kept constant.

Figure 6:
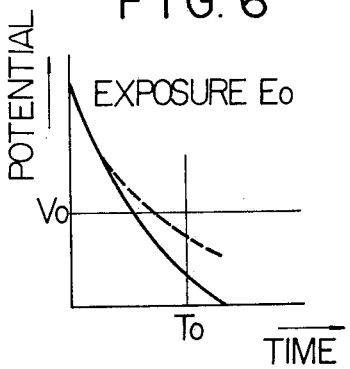
FIG. 6 shows the light decay curve that results when a standard copied image is obtained by a standard development bias voltage $V_0$ in accordance with the present invention.
Figure 7:
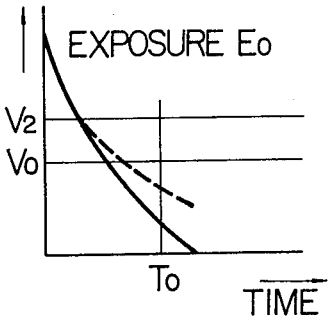
FIG. 7 shows the light decay curve as when the development bias voltage is increased up to $V_2$ in accordance with the present invention.

FIG. 6 shows the light decay curve when the standard copied image is obtained by the standard development bias potential $V_0$, and FIG. 7 shows the light decay curve when the development bias potential is increased up to $V_2$. From FIGS. 6 and 7, it can be seen that, when the development bias potential is increased in order to reduce the density of the copied image, the difference between the initial potential of the background and the potential of the background at the time of fatigue of the photoconductor does not appear on the copied image.

Figure 8:
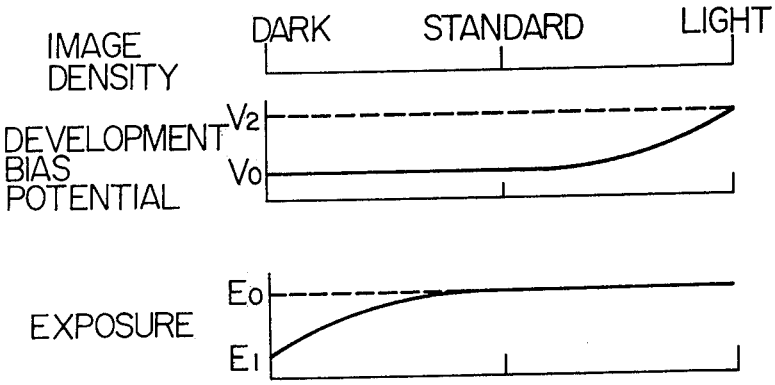
FIG. 8 shows the relationships among image density and development bias potential and exposure in accordance with the present invention.
Figure 9:
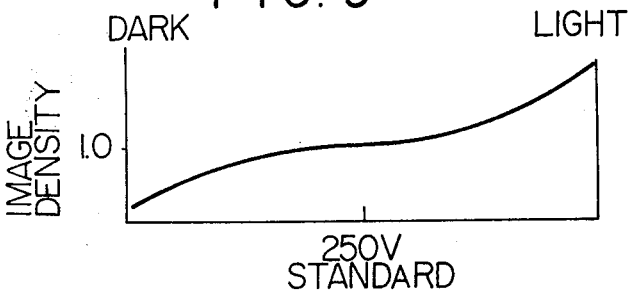
FIG. 9 shows the change of image density that results when the development bias potential or the exposure is continuously changed in accordance with the present invention.

FIG. 8 shows the relationships among the density of the copied image, the development bias potential and the exposure. The development bias potential and the exposure do not change abruptly near the standard image density range, but they change greatly. FIG. 9 shows the curve of the image density (reflected density) that results when the development bias potential or the exposure is continuously changed by image density adjustment apparatus. In this case, the image density adjustment apparatus is set so that a standard value of the reflected density can be obtained by applying 250 V of bias potential when the potention of a latent electrostatic image is 700 V in the standard image density range. As may be seen in FIG. 9, the image density curve changes gently near the standard image density range but, in the opposite end regions, the image density curve changes greatly. Normally, the copying machine is used most frequently near the standard image density range. Therefore, so long as the adjustment knob is near the standard image density range, almost the same bias voltage or exposure can be advantageously obtained even when the adjustment knob is not set precisely at the standard image density.

Figure 10:
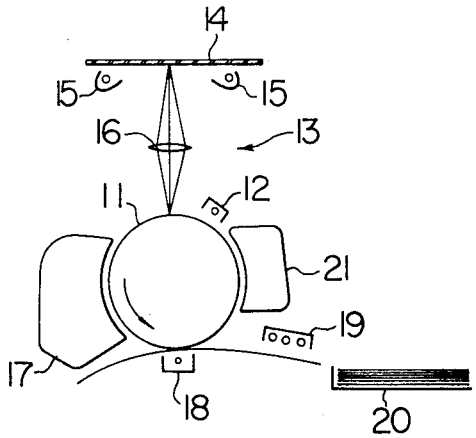
FIG. 10 is a schematic sectional view of an electrophotographic copying apparatus to be employed in accordance with the present invention.

FIG. 10 shows, schematically, electrophotographic copying apparatus to which the present invention can be applied. In FIG. 10, a photoconductor 11 is rotated in the direction of the arrow and the peripheral surface of the photoconductor 11 is uniformly charged by a charging apparatus 12 and is then exposed to a light image of an original document by exposure apparatus 13, so that an electrostatic image is formed on the photoconductor 11. In an exposure apparatus 13, the original document placed on a contact glass 14 is illuminated by a lamp 15 and the reflected light from the original document is focused on the photoconductor 11 by an optical system 16. At the same time, the original document is scanned as the contact glass 14 is moved. The electrostatic latent image on the photoconductor 11 is developed by development apparatus 17 and the developed image is transferred to a transfer sheet fed from a sheet feed apparatus by an image transfer apparatus 18. A developed toner image is fixed to the transfer sheet by an image fixing apparatus 19 and the transfer sheet is discharged onto a tray 20. In the meantime, the photoconductor 11 is cleaned by cleaning apparatus 21.

Figure 11:
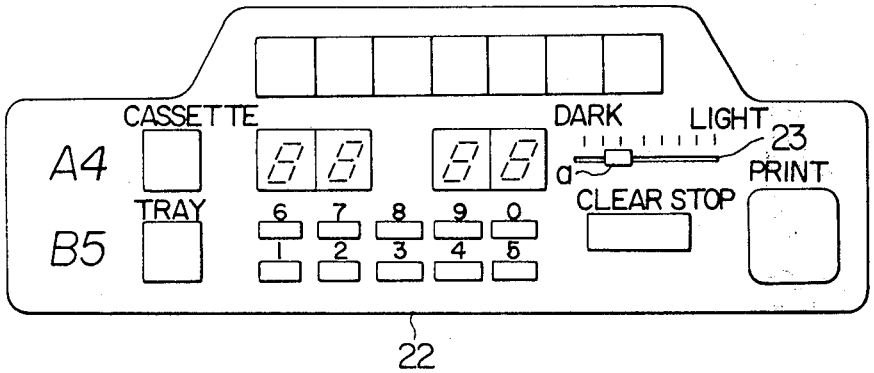
FIG. 11 is a plan view of a control panel of the electrophotographic copying apparatus of FIG. 10.

The electrophotographic copying apparatus is provided with a control panel 22 as shown in FIG. 11. The panel 22 is provided with switches and display units and image density adjustment apparatus 23. In the image density adjustment apparatus 23, a slide switch is employed and by positioning a movable knob a of the slide switch in the central portion of its range of travel, a standard image can be obtained. As the knob a is moved to the right, the image density of a copied image becomes lower and as the knob a is moved to the left, the image density of the copied image becomes high.

Figure 12:
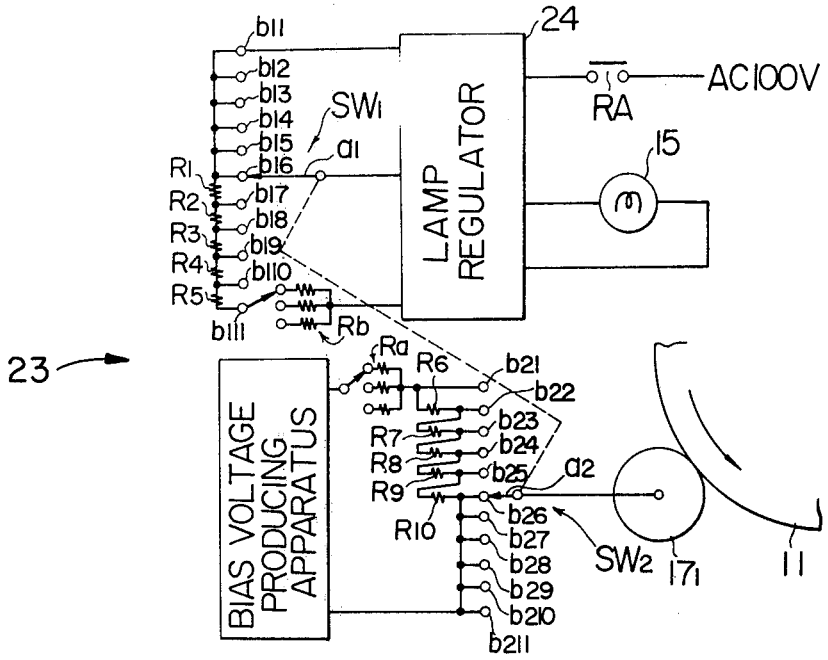
FIG. 12 is a wiring diagram of the control circuits in one embodiment of an image density adjustment apparatus in accordance with the present invention.

As shown in FIG. 12, the image density adjustment apparatus 23 comprises slide switches $SW_1$ and $SW_2$ each having 11 contacts. The slide switch $SW_1$ is connected to circuits for adjusting the output voltage of a lamp regulator 24 and the slide switch $SW_2$ to a development bias voltage producing apparatus. The output voltage of the lamp regulator 24 is, typically, 80 V when a movable contact $a_1$ of the slide switch $SW_1$ is connected to any of the contacts $b_{11}$ to $b_{16}$, which are short-circuited together. However, when the movable contact $a_1$ is moved into connection with a contact $b_{17}$, a resistor $R_1$ is connected to the lamp regulator 24. As a result, the output voltage of the lamp regulator 24 is reduced to 79 V. Likewise, when the movable contact $a_1$ is moved successively into connection with each of the contacts $b_{18}$, $b_{19}$, $b_{110}$ and $b_{111}$, resistors $R_1$, $R_2$, $R_3$, $R_4$, $R_5$ are successively connected in series to the lamp regulator 24 so that the output of the lamp regulator 24 is reduced to 78 V, 77 V, 75 V, 73 V, respectively. The lamp regulator 24 is connected to a 100 V AC power source by a contact RA of an exposure timing relay, which is timed with each exposure step to apply the output voltage of the lamp regulator 24 to the lamp. The development apparatus 17 consists of magnetic brush development apparatus employing a development sleeve $17_1$. When a movable contact $a_2$ of the slide switch $SW_2$ is connected to a contact $b_{21}$, an output voltage of 500 V from the bias voltage producing apparatus is applied to the development sleeve $17_1$. When the movable contact $a_2$ is moved successively into connection with contacts $b_{22}$, $b_{23}$, $b_{24}$, $b_{25}$ and $b_{26}$, the output voltage of the bias voltage producing apparatus is reduced in successive steps of 50 V, 50 V, 50 V, 25 V, and 25 V by resistors $R_6$, $R_7$, $R_8$, $R_9$ and $R_{10}$, respectively, so that potentials of 450 V, 400 V, 350 V, 300 V, 275 V and 250 V are respectively applied to the development sleeve $17_1$. The remaining contacts $b_{27}$, $b_{28}$, $b_{29}$, $b_{210}$, $b_{211}$ of the switch $SW_2$ are short-circuited together so that a potential of 250 V is applied to the development sleeve $17_1$ when the contact $a_2$ engages any of the latter contacts. In the slide switches $SW_1$ and $SW_2$, the contacts $a_1$ and $a_2$ are ganged together and are attached to the movable knob a, so that the output voltage of the lamp regulator 24 that controls the exposure and the bias potential that controls the development are varied as shown in FIGS. 8 and 9.

As the electric circuits for the above-mentioned image density adjustment apparatus 23, the resistor blocks (trade name of Matsushita Denki Co., Ltd.) can be employed by wiring the necessary resistors in appropriate combination for simplicity of assembling the image density adjustment apparatus 23.

Figure 13:
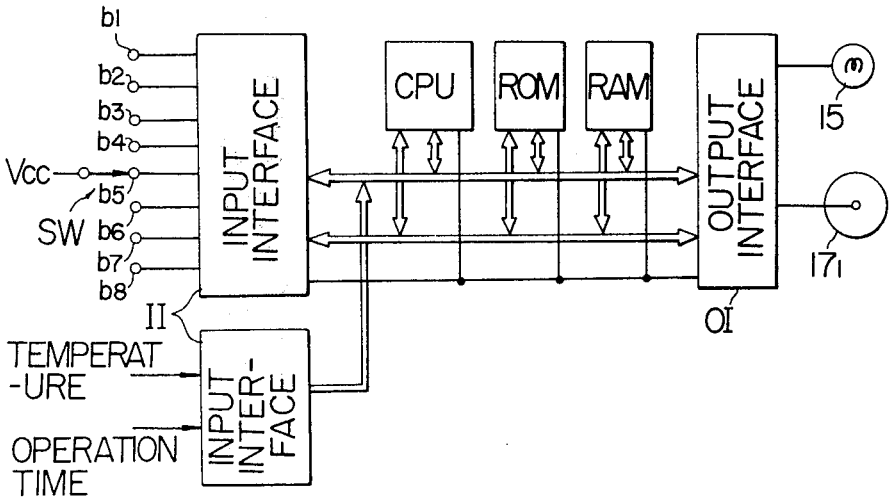
FIG. 13 is a wiring diagram of the control circuits of another embodiment of an image density adjustment apparatus in accordance with the present invention.

In the above-mentioned embodiment, the exposure and the development bias potential are controlled directly by the switches. However, FIG. 13 shows an alternative embodiment in which they are controlled by a microcomputer, as a result the most suitable voltage for the exposure lamp 15 and the most suitable development bias voltage are selected by the microcomputer, taking into account the environment conditions, such as the temperature and the operation time. These voltages are applied to the exposure lamp 15 and the development sleeve $17_1$ through an output interface 0I capable of performing DA conversion of the operation results obtained by the microcomputer, so that the exposure and the development bias potential can be controlled more accurately. In this case, the microcomputer comprises a central processing apparatus (CPU), a read only memory (ROM), a random access memory (RAM), an input interface II and an output interface 0I. A power source voltage $V_{CC}$ is fed to the input interface II of the microcomputer by way of the contacts $b_1$ to $b_8$ of a slide switch SW, which constitutes an image density adjustment apparatus. Furthermore, the environment condition signals, such as the temperature and the operation time, are also fed to the microcomputer through the input interface II.

When copying is performed for a long period of time using the image density adjustment apparatus shown in FIG. 12, the image density tends to increase since the photoconductor, the developer, and the lamp deteriorate and the optical system is smeared. Therefore, the image density adjustment apparatus 23 has to be operated so as to increase the bias potential. By incorporating a plurality of adjustment resistors Ra in the bias potential adjustment circuit, the image density adjustment apparatus can be adjusted so as to obtain the best images. Of course, by incorporating suitable adjustment resistors Rb in a lamp voltage adjustment circuit, the image density adjustment apparatus can be adjusted likewise. Furthermore, by adjusting the adjustment resistors Ra and Rb, the curves in FIG. 8 or FIG. 9 can be moved parallel to the ordinate or the abscissa of the graphs and the scattering of the image density adjustment of each image density adjustment apparatus can be adjusted and any images can be obtained as desired.

What is claimed is:

1. The method of adjusting the image density of images in electrophotographic copying apparatus comprising a photoconductor, exposure control means, and development bias means, said method comprising increasing the development bias potential while maintaining substantially constant the exposure to be applied to the photoconductor when copies having an image density lower than a predetermined standard image density are made, and decreasing the exposure while keeping the development bias potential substantially constant when copies having an image density greater than said predetermined image density are made.

2. The method as claimed in claim 1 in which material to be copied is illuminated by electric lamp means and the exposure is controlled by controlling the intensity of illumination on the material to be copied.

3. The method as claimed in claim 2 in which the intensity of illumination is controlled by controlling electric power to the electric lamp means.

4. Electrophotographic copying apparatus comprising a photoconductor, means to illuminate material to be copied, imaging means to direct onto said photoconductor an image of the material to be copied, development apparatus to develop said image, exposure control means to control the intensity of said image directed onto said photoconductor, said development apparatus comprising variable development bias voltage means, said common controlling means connected to said variable voltage means and to said exposure control means to reduce the intensity of said image directed onto said photoconductor while maintaining said development bias voltage substantially constant and, alternatively, to increase said development bias voltage while maintaining the intensity of said image directed onto said photoconductor substantially constant; said exposure control means comprising power controlling means connected to said means to illuminate material to be copied and connected to said common controlling means to be controlled thereby; said exposure control means comprising a first variable resistance means and said variable development bias voltage means comprises a second variable resistance means and said common controlling means comprises a mechanical linkage connected to both said first and said second variable resistance means; said first variable resistance means comprising first contact means that moves over a first predetermined range of travel between first and second ends with respect to said first resistance means and varies said exposure more at said first end of said range of travel than at said second end, and said second variable resistance means comprises second contact means that moves over a second predetermined range of travel between first and second ends with respect to said second resistance means and varies said development bias voltage more at said second end than at said first end, said first and second contact means being mechanically connected to move together.

5. The invention as defined in claim 4 in which said first and second variable resistance means comprise first and second slide switches and said first and second contact means slide along said first and second slide switches, respectively.

6. Electrophotographic copying apparatus comprising a photoconductor, means to illuminate material to be copied, imaging means to direct onto said photoconductor an image of the material to be copied, development apparatus to develop said image, exposure control means to control the intensity of said image directed onto said photoconductor, said development apparatus comprising variable development bias voltage means, said common controlling means connected to said variable voltage means and to said exposure control means to reduce the intensity of said image directed onto said photoconductor while maintaining said development bias voltage substantially constant and, alternatively, to increase said development bias voltage while maintaining the intensity of said image directed onto said photoconductor substantially constant, a microcomputer, said common controlling means being connected thereto, said microcomputer being connected to said means to illuminate material to control the intensity of said image and being connected to said development bias voltage means to control said development bias voltage.

7. The invention as defined in claim 6 in which said microcomputer controls both said development bias voltage and said intensity of said image in accordance with the environmental conditions of said apparatus.

8. Electrophotographic copying apparatus comprising a photoconductor; means to illuminate material to be copied; imaging means to direct onto said photoconductor an image of the material to be copied; development apparatus to develop said image; exposure control means to control the intensity of said image directed onto said photoconductor; said development apparatus comprising variable development bias voltage means; common controlling means connected to said variable voltage means and to said exposure control means to reduce the intensity of said image directed onto said photoconductor while maintaining said development bias voltage substantially constant and, alternatively, to increase said development bias voltage while maintaining the intensity of said image directed onto said photoconductor substantially constant; wherein said illuminating means includes a lamp; said exposure control means comprising a voltage regulator connected to said lamp to vary the intensity responsive to the output voltage of the regulator, a first variable resistance means connected to said regulator operable to selectively vary the output voltage; said variable development bias voltage means comprising a second variable resistance means; said common controlling means comprising a mechanical linkage connected to both said first and said second variable resistance means; said exposure control means further comprising first contact means that moves over a first predetermined range of travel between first and second ends with respect to said first resistance means and varies said exposure more at said first end of said range of travel than at said second end; said variable delopment bias voltage means further comprising second contact means that moves over a second predetermined range of travel between first and second ends with respect to said second resistance means and varies said development more at said second end than at said first end; and said first and second contact means being mechanically connected to move together.

* * * * *